US012539946B2

(12) United States Patent
Valverde

(10) Patent No.: US 12,539,946 B2
(45) Date of Patent: Feb. 3, 2026

(54) THREADED BOAT DRAIN PLUG WITH ERGONOMIC GRIP AND LIGHT ENABLED GARBOARD

(71) Applicant: Proxamus LLC, The Woodlands, TX (US)

(72) Inventor: Eduardo Valverde, The Woodlands, TX (US)

(73) Assignee: Proxamus LLC, The Woodlands, TX (US)

( * ) Notice: Subject to any disclaimer, the term of this patent is extended or adjusted under 35 U.S.C. 154(b) by 583 days.

(21) Appl. No.: 17/993,739

(22) Filed: Nov. 23, 2022

(65) Prior Publication Data

US 2023/0159140 A1 May 25, 2023

Related U.S. Application Data

(60) Provisional application No. 63/282,494, filed on Nov. 23, 2021.

(51) Int. Cl.

| | |
|---|---|
| ***B63B 45/04*** | (2006.01) |
| ***B63B 13/00*** | (2006.01) |
| ***B63B 17/00*** | (2006.01) |

(52) U.S. Cl.

CPC ..... *B63B 45/04* (2013.01); *B63B 13/00* (2013.01); *B63B 17/00* (2013.01); *B63B 2017/0045* (2013.01)

(58) Field of Classification Search

CPC ..... B63B 45/00; B63B 45/04; B63B 13/00; B63B 13/02; B63B 17/00; B63B 2017/0045

USPC ..... 114/197, 227

See application file for complete search history.

(56) References Cited

U.S. PATENT DOCUMENTS

| | | | | |
|---|---|---|---|---|
| 2,990,798 | A | 7/1961 | Pribyl | |
| 3,029,768 | A | 4/1962 | Spurlock | |
| 3,896,280 | A | 7/1975 | Blake | |
| 4,019,454 | A | 4/1977 | Landwerlen | |
| 5,966,080 | A | 10/1999 | Bigsby | |
| 6,035,702 | A | 3/2000 | Graham | |
| 6,615,760 | B1 | 9/2003 | Wise et al. | |
| 7,191,722 | B1 * | 3/2007 | Plost | B63B 13/02 114/197 |
| 7,316,195 | B2 * | 1/2008 | DeHart | B63B 13/00 114/197 |
| 7,520,644 | B2 * | 4/2009 | Jordan | B63B 45/04 362/267 |

(Continued)

OTHER PUBLICATIONS

USPTO Non-Final Office Action for U.S. Appl. No. 16/197,903 dated Jan. 2, 2020.

(Continued)

*Primary Examiner* — Lars A Olson
(74) *Attorney, Agent, or Firm* — Tumey L.L.P.

(57) ABSTRACT

A garboard drain plug system comprising an ergonomic grip which may aid in tightening and loosening the drain plug by hand without special tools. The garboard drain plug system may comprise a light ring which may surround a garboard, and thereby illuminate an area adjacent to, or surrounding, the garboard. Together, the ergonomic drain plug, garboard, and lighted garboard ring may act alone or in cooperation to provide a method of controlling communication of a fluid through a drain of a hull or transom of a boat or vessel.

13 Claims, 6 Drawing Sheets

(56) References Cited

U.S. PATENT DOCUMENTS

| | | | |
|---|---|---|---|
| 10,836,455 | B2 | 11/2020 | Valverde et al. |
| 2018/0127961 | A1 | 5/2018 | Homami et al. |

OTHER PUBLICATIONS

USPTO Notice of Allowance for U.S. Appl. No. 16/197,903 dated Jun. 23, 2020.
USPTO Issue Notification for U.S. Appl. No. 16/950,858 dated Aug. 31, 2022.
USPTO Notice of Allowance for U.S. Appl. No. 16/950,858 dated May 13, 2022.
USPTO Non-Final Office Action for U.S. Appl. No. 16/950,858 dated Feb. 9, 2022.
USPTO Issue Notification for U.S. Appl. No. 16/197,903 dated Oct. 28, 2020.

* cited by examiner

THREADED BOAT DRAIN PLUG WITH ERGONOMIC GRIP AND LIGHT ENABLED GARBOARD

CROSS-REFERENCE TO RELATED APPLICATIONS

This application is a non-provisional application that claims the benefit of U.S. Provisional Application No. 63/282,494 filed on Nov. 23, 2021, the entire contents of which are incorporated by reference herein in its entirety.

STATEMENT REGARDING FEDERALLY SPONSORED RESEARCH OR DEVELOPMENT

Not applicable.

BACKGROUND OF THE INVENTION

Field of the Invention

This invention is directed to a drain plug for the bilge area of a boat. Recreational boats including motor and sail boats are normally fitted with a drain plug to drain water from the bilge area of the boat. These drain plugs are commonly referred to as garboard plugs.

Background of the Invention

Boats or other vessels are commonly employed for recreational or commercial use, and are often at risk of water or other fluids collecting in the transom or hull, which may hinder operational performance or present other risks. For example, boats may be exposed to rain when operating or docked without a cover, or may collect water which may splash into the boat when operating or from swimmers entering the boat while anchored offshore. Other fluids, such as fuel or oil which may have spilled from a boat's engine may also collect in the transom or hull.

Typically, boats or vessels may be outfitted with one or more removable plugs which may be secured into a garboard located about a transom or hull, often referred to as a drain plugs, to provide a means of draining the water or other fluids. When securely installed, the drain plugs may prevent water from entering the transom or hull while the boat or vessel is deployed into a body of water such as a lake, river, or other navigable body. Upon being removed from the body of water, for example, in order to tow or store the boat or vessel, the drain plug may then be removed, thereby allowing any water or other fluids which may have collected in the transom or hull to drain from the boat or vessel, since the drain plugs are typically located about a lower-most point of the transom or hull.

Prevailing drain plug designs are commonly threaded, square brass nuts which can be cumbersome to tighten and loosen since they typically require special tools and are difficult to grip by hand. Additionally, the garboard and plug are generally installed in areas of the boat or vessel which are difficult to access or may offer poor visibility. Consequently, there is a need for an improved drain plug system which offers both an ergonomic grip allowing the plug to be tightened and loosened by hand, and improved visibility, such that boat and vessel operators can more easily secure and loosen the drain plugs.

BRIEF SUMMARY OF SOME OF THE PREFERRED EMBODIMENTS

These and other needs in the art are addressed in one embodiment by a garboard drain plug system comprising an ergonomic grip which may aid in tightening and loosening the drain plug by hand without special tools. The garboard drain plug system may comprise a light ring which may surround a garboard, and thereby illuminate an area adjacent to, or surrounding, the garboard. Together, the ergonomic drain plug, garboard, and lighted garboard ring may act alone or in cooperation to provide a method of controlling communication of a fluid through a drain of a hull or transom of a boat or vessel.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1A:
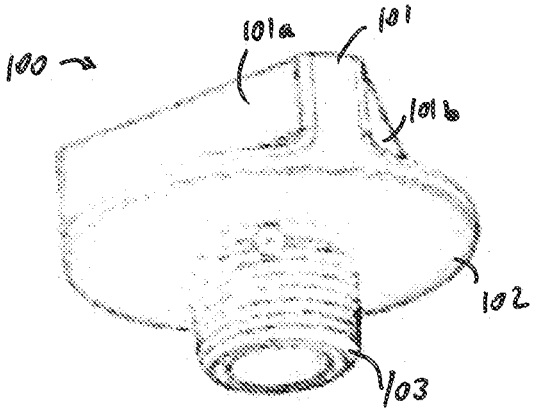
FIG. 1A illustrates a first isometric view of an embodiment of an ergonomic drain plug.
Figure 1B:
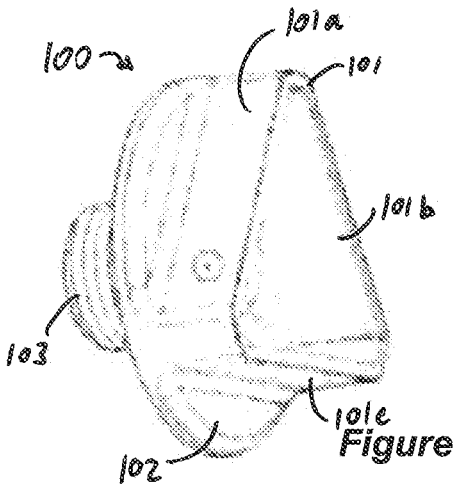
FIG. 1B illustrates a second isometric view of an embodiment of an ergonomic drain plug.
Figure 1C:
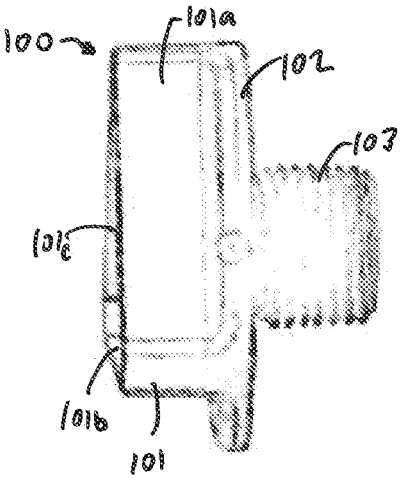
FIG. 1C illustrates a third isometric view of an embodiment of an ergonomic drain plug.
Figure 1D:
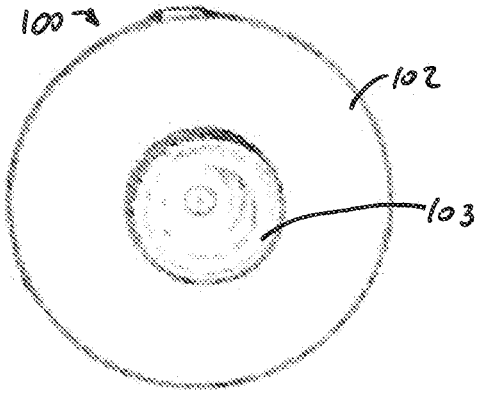
FIG. 1D illustrates a fourth isometric view of an embodiment of an ergonomic drain plug.
Figure 2A:
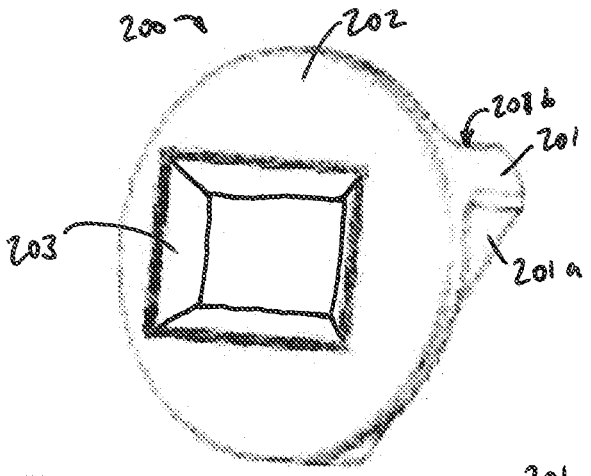
FIG. 2A illustrates a first isometric view of an embodiment of an ergonomic drain plug handle.
Figure 2B:
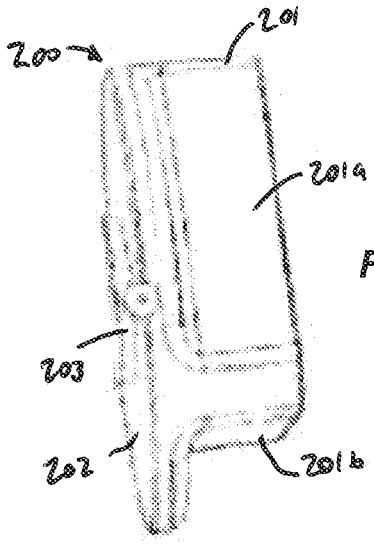
FIG. 2B illustrates a second isometric view of an embodiment of an ergonomic drain plug handle.
Figure 2C:
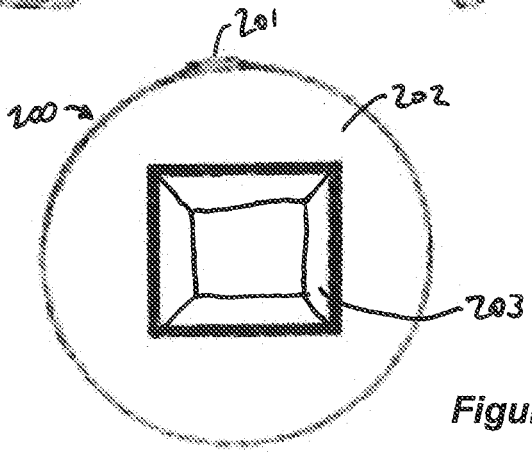
FIG. 2C illustrates a third isometric view of an embodiment of an ergonomic drain plug handle.
Figure 2D:
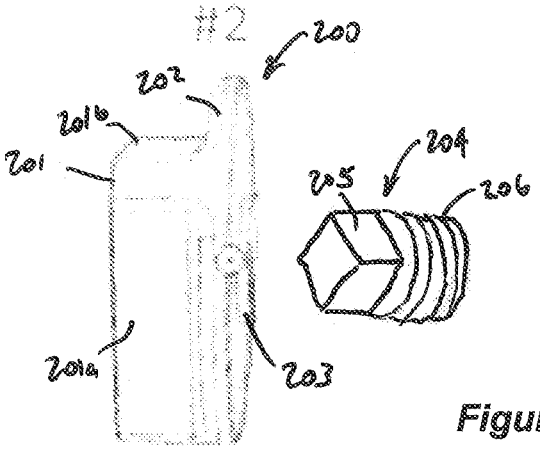
FIG. 2D illustrates an exploded view of an embodiment an ergonomic drain plug handle and a drain plug.
Figure 3A:
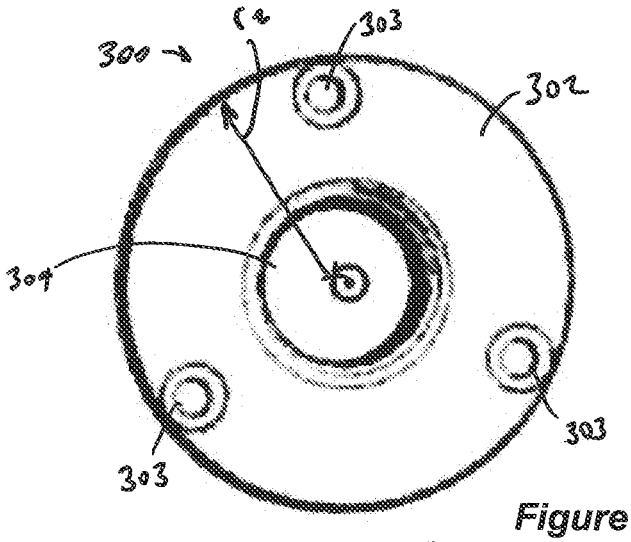
FIG. 3A illustrates a first isometric view of an embodiment of a garboard.
Figure 3B:
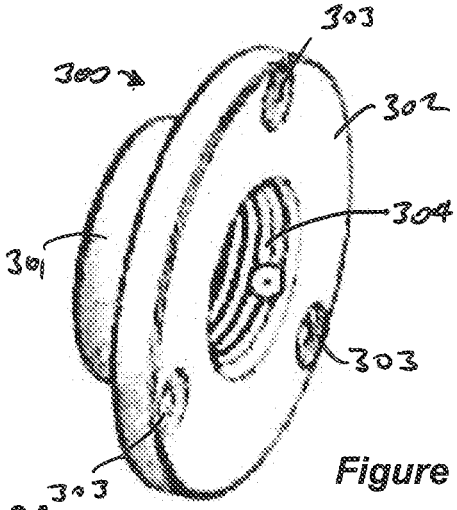
FIG. 3B illustrates a second isometric view of an embodiment of a garboard.
Figure 3C:
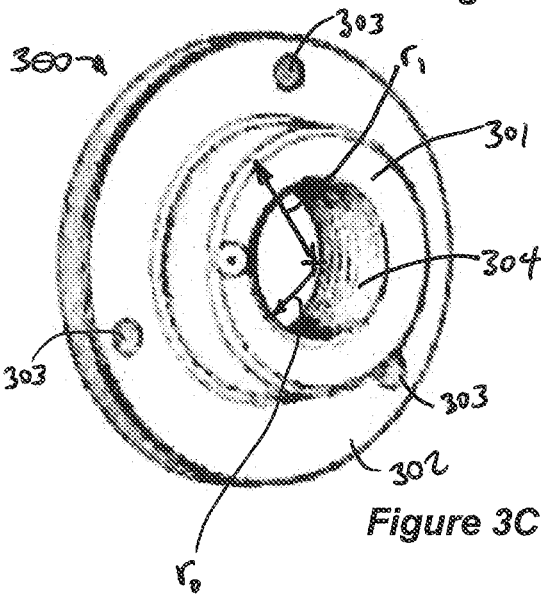
FIG. 3C illustrates a third isometric view of an embodiment of a garboard.
Figure 3D:
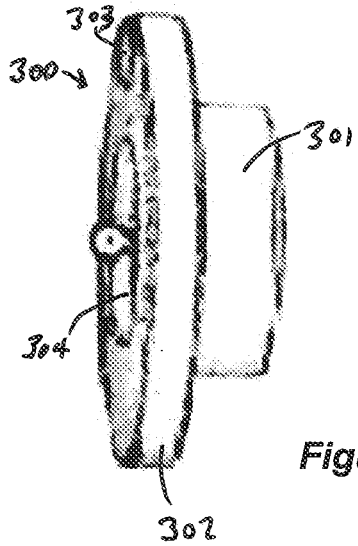
FIG. 3D illustrates a fourth isometric view of an embodiment of a garboard.

FIGS. 1A-1D and 2A-2D illustrate alternate embodiments of an ergonomic garboard drain plug, where FIGS. 1A-1D illustrate an embodiment of drain plug 100, principally comprising gripping portion 101, base portion 102, and plug portion 103, and FIGS. 2A-2D illustrate an embodiment of drain plug handle 200, principally comprising gripping portion 201, base portion 202, and socket 203. In embodiments, drain plug handle 200 may be formed in a manner which may be adapted to securely receive drain plug 204 in a manner which will be described below, which may be any garboard drain plug currently known in the art. For ease of reference, drain plug handle 200, when combined with drain plug 204, will be referred to as drain plug 200'.

Gripping portion 101,201 may provide one or more ergonomic surfaces of a size and shape which allow a person to comfortably attain sufficient manual purchase on drain plug 100,200' to enable the person to secure or loosen drain plug 100,200' within a garboard without need for separate tools. In exemplary embodiments, gripping portion 101,201 may comprise one, two, three, four, five, or more gripping surfaces which provide a surface against which a person may apply a force or pressure with one or more fingers of their hand while enabling the person to apply sufficient torque to drain plug 100,200' to partially or fully seat drain plug 100,200' in a garboard, or alternatively to partially or fully loosen drain plug 100,200' from a fully or partially seated position in a garboard. In the embodiment shown, drain plug 100 and drain plug handle 200 are shown having three such ergonomic gripping surfaces, 101*a*,201*a*, 101*b*, 201*b*, and 101*c*,201*c*, respectively. Without limitation, in embodiments the general size and shape of gripping portion 101,201 may be similar in design to triangular knob 3 as disclosed in U.S. Pat. No. 10,836,455, issued Nov. 17, 2020, and U.S. Pat. No. 11,447,207, issued Sep. 20, 2022, the entire contents of which are hereby incorporated herein by reference thereto. In embodiments, all or a portion of each of the one or more ergonomic gripping surfaces of gripping portion 101,201 may abut base portion 102,202 of drain plug 100,200', for example in the manner shown.

Base portion 102,202 may be formed having any suitable size and shape which may allow drain plug 100,200' to be securely seated into a garboard, and may provide a first surface against which all or a portion of gripping portion 101,201 may abut, and a second surface which may be brought into interference contact with the garboard upon becoming fully and/or securely seated. For example, base portion 102,202 may be formed to have a generally triangular, diamond, rectangular, square, pentagon, hexagon, heptagon, octagon, decagon, oval, or round shape, or combinations thereof. In the embodiment shown, base portion 102,202 is illustrated as being formed to have a round shape. In embodiments, base portion 102,202 may be formed to have a thickness which may provide sufficient strength to accept a torque applied to gripping portion 101,201 without damage when drain plug 100,200' is fully and/or securely seated in a garboard.

As can be seen in FIGS. 1A-1D, drain plug 100 has been formed to comprise plug portion 103, which may be any suitable protrusion adapted to be received by a garboard, for example via a threaded connection as shown. As can be seen in FIGS. 2A-2D, drain plug handle 200 has been formed to comprise socket 203, which may be formed as a recessed feature suitably adapted to receive corresponding portion 205 of drain plug 204. In embodiments, drain plug 204 may be secured into socket 203 through any known methods which may suitably secure drain plug handle 200 to drain plug 204 which may be capable of sustaining operational conditions of the boat or vessel into which drain plug 200' may be installed. For example, drain plug handle 200 may be securely joined to drain plug 200 via a friction fit or interference fit, or socket 203 may be formed to accept one or more features of drain plug 204 or portion 205, for example a pin, or socket 203 may be provided with dogs or other features which may securely receive one or more threads of drain plug threaded portion 206. In embodiments, these alternate methods of securing drain plug handle 200 to drain plug 204 may be supplemented with additional method of providing secure attachment, for example by applying a marine adhesive or thread locking adhesive to one or more features of socket 203 or one or more featured of drain plug 204. In embodiments, plug portions 103,206 of drain plug 100,200' may be adapted to be received by a drain of a corresponding garboard, for example by being provided with external threads as shown at 103,206.

Referring now to FIGS. 3A-3D, an embodiment of garboard 300 is shown having a form generally similar to prevailing designs known in the art. As can be seen, garboard 300 principally comprises raised portion 301 having outermost radius $r_1$ and base portion 302 having outermost radius $r_2$. Garboard 300 may be formed to include, or may be provided with, one or more apertures 302 which may be adapted to receive corresponding fasteners which may secure garboard 300 to a surface of a boat or vessel's hull or transom. As is known in the art, the length and radius $r_1$ of raised portion 301 may correspond to a hole which may be provided by, or drilled through, the hull or transom. In embodiments, the surface of base portion 302 against which raised portion 301 may abut may be intended to be brought into surface contact with the hull or transom into which garboard 300 may be installed, and this surface may be formed to have a flat surface profile or alternatively may be formed to comprise one or more recessed surface features, for example to accommodate a sealing element or sealing material applied between the garboard 300 and the hull or transom. In embodiments, garboard 300 may be formed to comprise drain 304, which may generally be formed as a central bore located to coincide with a central axis of garboard 300 and having radius $r_0$. In embodiments, drain 304 may be adapted to receive a corresponding drain plug, for example by being provided with internal threads as shown.

Figure 4A:
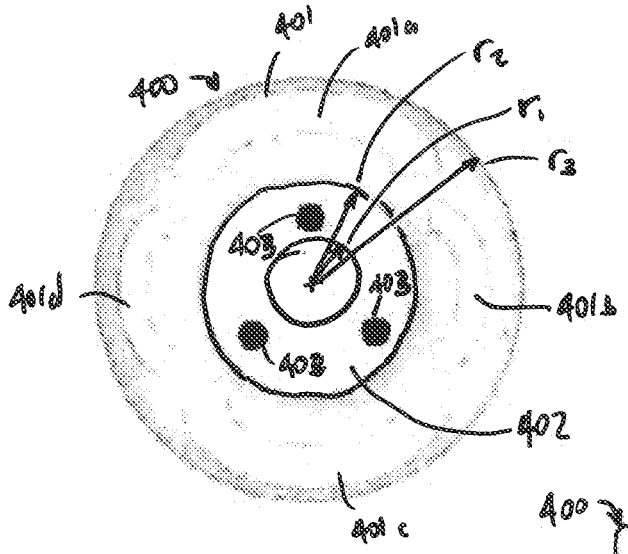
FIG. 4A illustrates a first view of an embodiment of a garboard light ring.
Figure 4B:
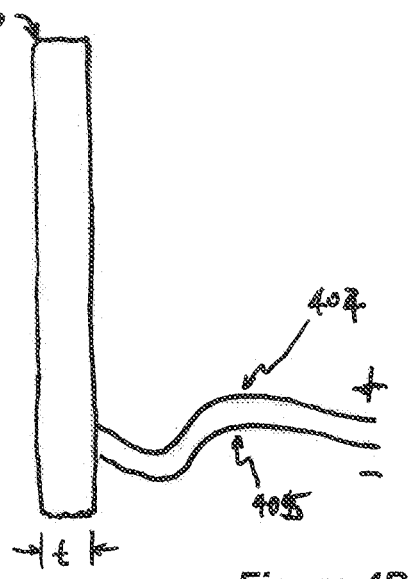
FIG. 4B illustrates a second view of an embodiment of a garboard light ring.

Referring now to FIGS. 4A and 4B, an embodiment of garboard light ring 400 is shown which may illuminate all or a portion of an area located in proximity to a garboard, and may principally comprise lighted portion 401 and garboard mounting portion 402. In embodiments, garboard light ring 400 may be formed to have any size and shape suitable to be mounted between garboard 300 and a hull or transom of a boat or vessel. For example garboard light ring 400 may be formed to have a shape which may be generally triangular, diamond, rectangular, square, pentagon, hexagon, heptagon, octagon, decagon, oval, or round shape, or combinations thereof. In the embodiment shown, garboard light ring 400 is shown to comprise a circular shape, with lighted portion 401 defined by the area between radius $r_3$ and $r_2$, and garboard mounting portion 402 defined by the area between radius $r_1$ and $r_2$, where radius $r_1$ may correspond to, and be adapted to receive, radius $r_1$ of raised portion 301 of garboard 300, and radius $r_2$ may correspond to, and be adapted to receive, radius $r_2$ of base portion 302 of garboard 300.

In embodiments, garboard mounting portion 402 may be provided with one or more apertures 403, which may correspond in size and position to each of the one or more apertures 302 of garboard 300. In embodiments, garboard mounting portion 402 may be provided with a surface shape which may be formed to conform to, be received by, or be adapted to receive one or more corresponding surface features of the surface of garboard 300 which will be brought into contact with garboard mounting portion 402. In this manner, garboard mounting portion 402 may be configured to provide a water- or air-tight seal between garboard 300 and garboard light ring 400 when installed on a hull or transom of a boat or vessel in a manner which will later be described. In alternate embodiments, garboard mounting portion 402 may be provided with one or more recessed surface features which may accommodate one or more sealing elements (not shown), or may be formed such that all or a portion of garboard mounting portion comprises a material which may provide a seal between garboard 300 and garboard light ring 400. Garboard mounting portion 402 may be formed having a thickness which may allow raised portion 301 of garboard 300 to be securely seated within a bore or hole of a hull or transom while maintaining a water- or air-tight seal between garboard 300 and the hull or transom.

In embodiments, lighted portion 401 may be formed to provide an internal volume suitable for locating one or more light sources, and may be provided with a transparent or translucent surface on one or more sides which may allow the one or more light sources to be visible to a person observing the hull or transom on which garboard light ring 400 may be installed. In embodiments, lighted portion 401 may be fitted with one or more light sources within the internal volume. For example, without limitation the one or more light sources may comprise known incandescent or LED-type lighting, or combinations thereof, and garboard light ring may be provided with a wiring harness comprising electrical leads 404,405, which may allow, for example, electrical communication with corresponding positive and negative leads of a power source or power system of the boat or vessel. In embodiments, the one or more light sources may be configurable to produce lighting which may vary in brightness, color, or color temperature, or may be modulated among variations in brightness, color, color temperature, or combinations thereof, which may be determined to be aesthetically pleasing. In embodiments, such variations may be controlled through a remote control, which may comprise a dedicated controller, one or more switches in communication with the power system of the boat or vessel, or a software-based application which may be installed on a mobile device, any of which may communicate with garboard light ring 400 through suitable wired or wireless communications media. In the embodiment shown, remote control 700 is illustrated as communicating wirelessly with garboard light ring 400.

Garboard light ring 400 may be formed to provide a surface suitable to be secured in contact with a hull or transom of a boat, and may provide one or more methods of forming a water- or air-tight seal against the hull or transom. For example, in exemplary embodiments, the surface of garboard light ring 400 which may contact the hull or transom when garboard light ring 400 is secured to a boat or vessel may be provided with one or more recessed surface features which may be adapted to receive one or more sealing elements, or all or a portion of the surface of garboard light ring 400 which may contact the hull or transom when garboard light ring 400 is secured to a boat or vessel may be formed from a material which may provide a suitable water- or air-tight seal against the hull or transom.

Figure 5A:
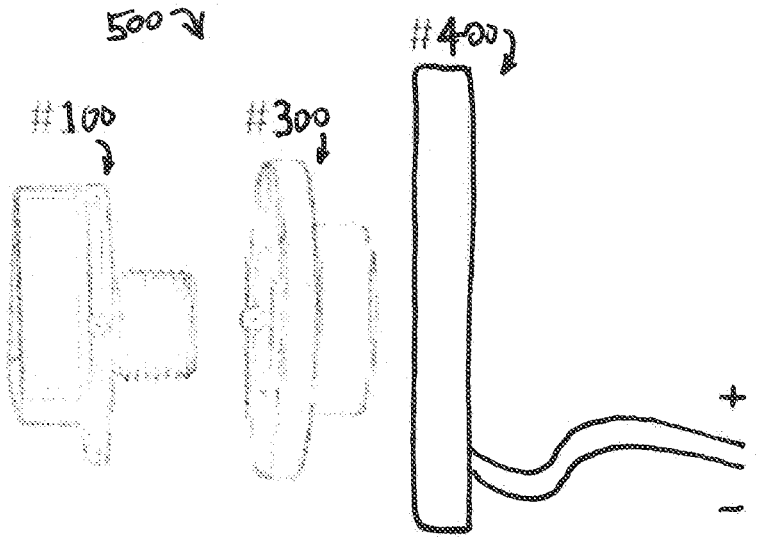
FIG. 5A illustrates an exploded view of an embodiment of a drain plug system comprising an ergonomic drain plug and garboard light ring.
Figure 5B:
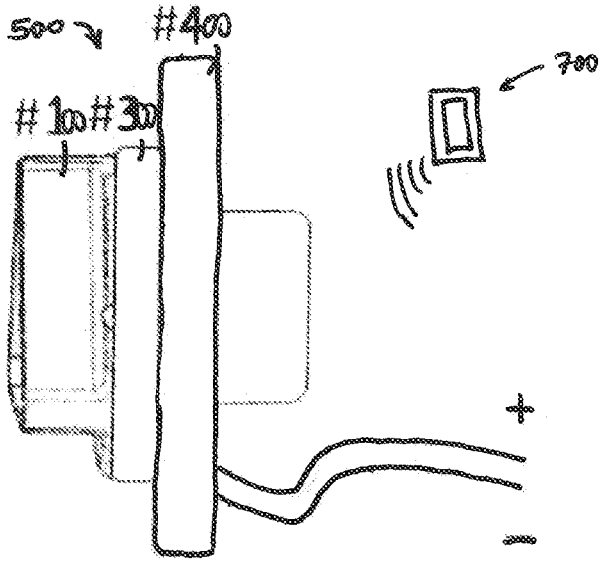
FIG. 5B illustrates an assembled view of an embodiment of a drain plug system comprising an ergonomic drain plug and garboard light ring.
Figure 6A:
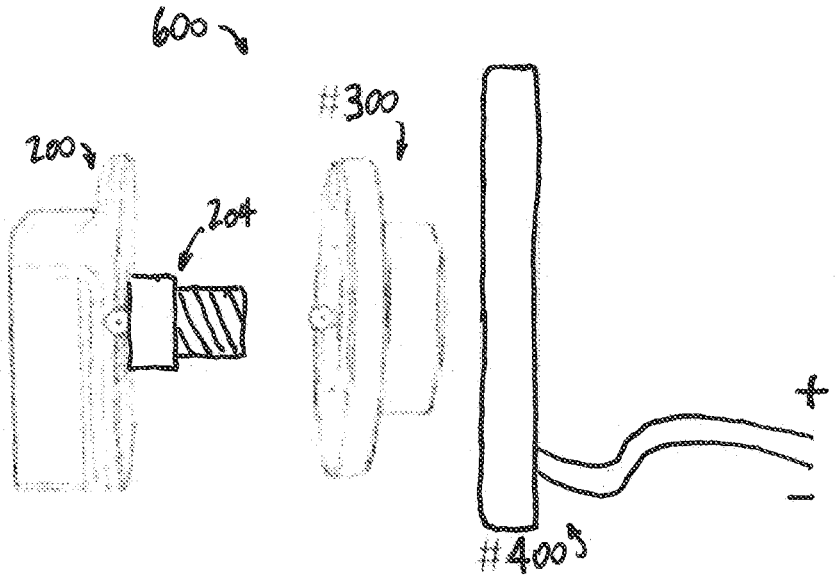
FIG. 6A illustrates an exploded view of an embodiment of a drain plug system comprising an ergonomic drain plug handle and garboard light ring.
Figure 6B:
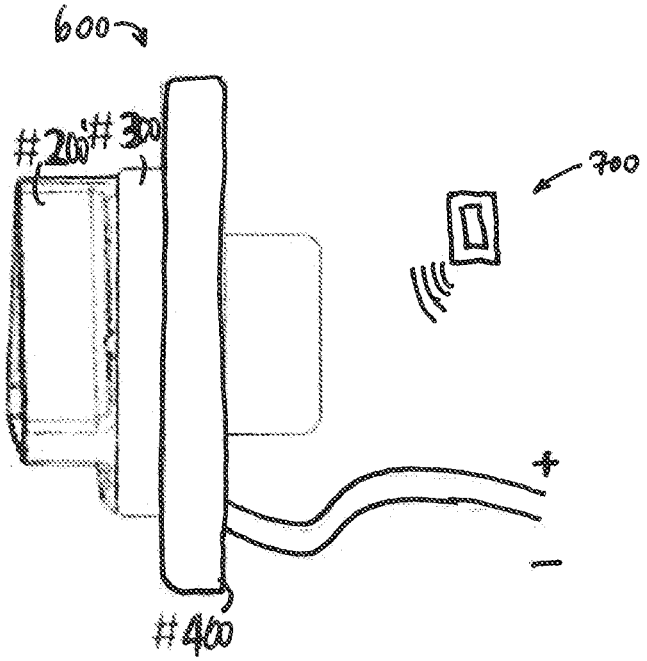
FIG. 6B illustrates an assembled view of an embodiment of a drain plug system comprising an ergonomic drain plug handle and garboard light ring.

Turning now to FIGS. 5A-5B and FIGS. 6A-6B, two embodiments of a drain plug system comprising an ergonomic grip and light are shown. In the embodiment of FIGS. 5A-5B, drain plug system 500 is shown comprising drain plug 100, garboard 300, and garboard light ring 400, with FIG. 5A illustrating each in an exploded view, and FIG. 5B illustrating each in an assembled view. In the embodiment of FIGS. 6A-6B, drain plug system 600 is shown comprising drain plug 200', formed from drain plug handle 200 and drain plug 204, garboard 300, and garboard light ring 400, with FIG. 6A illustrating each in an exploded view and FIG. 6B illustrating each in an assembled view.

In each embodiment of drain plug system 500,600, drain plug 100,200', garboard 300, and garboard light ring 400 are arranged to share a common central axis which may be aligned to coincide with a central axis of a drain hole of a hull or transom of a boat or vessel. Garboard light ring 400 may then be positioned to be in contact with a surface of the hull or transom, and garboard 300 may be positioned to be in contact with garboard mounting portion 402 of garboard light ring 400, with each of the one or more corresponding apertures 303 of garboard 300 aligning with each of the one or more apertures 403 of garboard light ring 400. Next, fasteners may be inserted into each of the corresponding apertures 303,403 and secured into the hull or transom, thereby securing garboard 300, and in turn garboard light ring 400, to the hull or transom. In certain embodiments, suitable sealing elements may be positioned between garboard 300 and garboard light ring 400, and/or between garboard light ring 400 and the hull or transom, as previously described. Garboard 300 may then receive drain plug 100,200', which when fully seated and secured within garboard 300, may provide a water- or air-tight seal at the drain hole provided in the hull or transom. Upon being secured to the boat or vessel, electrical leads 404,405 of garboard light ring may be connected to the power source or power system of the boat or vessel as may be appropriate.

In alternate embodiments, drain plug system 500,600 may be secured to an internal surface or external surface of a hull or transom in the manner described, or adaptations of one or more garboards 300 and one or more garboard light rings 400 may be suitably arranged in a similar manner which may provide a water- or air-tight seal at one or more internal or external surface locations of a hull or transom, or combinations thereof. In embodiments, drain plug system 500,600 may be adapted for application in other suitable, non-marine environments. For example drain plug system 500,600 may be adapted for use in refrigerated and non-refrigerated beverage coolers or ice chests, or similar such applications which may make it desirable to provide an ergonomic grip and/or a light source located in proximity to a fluid drain.

In embodiments, all or a portion of drain plug 100, drain plug handle 200, garboard 300, and garboard light ring 400 may be formed from any metallic or non-metallic material which may be suitable for use in environments exposed to water or other fluids. For example, drain plug 100, drain plug handle 200, and/or garboard 300 may be manufactured through 3D printing or injection molding of suitable non-metallic materials such as plastics, or may be cast, machined, or otherwise formed from suitable metallic materials such as brass, aluminum, or stainless steel. In further examples, garboard light ring 400 may be formed to comprise a base manufactured through 3D printing or injection molding of suitable non-metallic materials such as plastics, or may be cast, machined, or otherwise formed from suitable metallic materials such as brass, aluminum, or stainless steel.

The ergonomic and lighted drain plug system just described provides a number of advantages over prevailing alternatives. For example, garboard drains having a blade-type handle are known in the art, however the designs currently available are generally not ergonomically designed, and the person opening or closing the drain may find it necessary to pinch the blade-type handle or alternatively utilize some form of assistive tool, such as pliers, in order to fully tighten or loosen the drain plug. Additionally, lighted drain plugs are available on the market which provide a light source located in the plug itself. These designs are often less favorable in that they typically comprise power leads soldered or otherwise attached to the plug which may become twisted and stressed as the plug is tightened and loosened, presumably over multiple cycles throughout the lifetime of the drain plug. In contrast, the garboard light ring of the instant design remains stationary, without the need to apply any twisting or turning to the power leads of the garboard light ring. Further, the ergonomic drain plug handle can be incorporated into retrofit applications, thereby converting a commonly available drain plug with, for example, a square or hex shape nut to an ergonomic drain plug. Embodiments of drain plug 100,200', garboard light ring 400, and drain plug systems 500,600 may enable a more enjoyable or convenient method of draining bilge water from a boat or vessel as a result of the ergonomic and visibility benefits of each.

Although the present invention and its advantages have been described in detail, it should be understood that various changes, substitutions and alterations may be made herein without departing from the spirit and scope of the invention as defined by the appended claims.

What is claimed is:

1. A garboard light ring, comprising:

a lighted portion; and a garboard mounting portion;

wherein the lighted portion surrounds the garboard mounting portion, and wherein the garboard light ring is configured to illuminate at least a portion of an area located in proximity to a garboard, and wherein the garboard light ring is formed to provide a surface adapted to be secured in contact with a hull or transom of a boat.

2. The garboard light ring of claim 1, wherein the surface is formed to include one or more recessed surface features adapted to receive one or more sealing elements.

3. A garboard light ring, comprising:

a lighted portion; and a garboard mounting portion;

wherein the lighted portion surrounds the garboard mounting portion, and wherein the garboard light ring is configured to illuminate at least a portion of an area located in proximity to a garboard, and wherein the lighted portion is formed to provide an internal volume, wherein one or more light sources are fitted within the internal volume, and wherein the garboard light ring is provided with a transparent or translucent surface on one or more sides of the garboard light ring which allow the one or more light sources to be visible.

4. The garboard light ring of claim 3, wherein the one or more light sources comprises an incandescent light source, an LED light source, or combinations thereof.

5. The garboard light ring of claim 4, wherein the garboard light ring is provided with one or more electrical leads which allow the one or more light sources to electrically communicate with a power system of a boat or vessel.

6. The garboard light ring of claim 4, wherein the one or more light sources are configured to produce lighting which may vary in brightness, color, color temperature, or combinations thereof.

7. The garboard light ring of claim 6, wherein the lighting is controlled by a remote control.

8. The garboard light ring of claim 7, wherein the remote control comprises a dedicated controller.

9. The garboard light ring of claim 7, wherein the remote control comprises one or more switches in communication with a power system of a boat or vessel.

10. The garboard light ring of claim 7, wherein the remote control comprises a software-based application installed.

11. The garboard light ring of claim 10, wherein the software-based application is installed on a mobile device.

12. The garboard light ring of claim 7, wherein the remote control communicates with the garboard light ring through a wired communications media.

13. The garboard light ring of claim 7, wherein the remote control communicates with the garboard light ring through a wireless communications media.

* * * * *